US005718820A

United States Patent [19]

Morel et al.

[11] Patent Number: 5,718,820

[45] Date of Patent: Feb. 17, 1998

[54] PETROLEUM FUEL BASE

[75] Inventors: Frédéric Morel, Sainte Foy les Lyon; Marc Boulet, Le Havre; Massimo Zuliani, Neuilly sur Seine; Jean Claude Company, Mareil Marly; Paul Mikitenko, Noisy le Roy; Roben Loutaty, Le Havre, all of France

[73] Assignee: Institut Francais du Petrole, Rueil Malmaison, France

[21] Appl. No.: 638,964

[22] Filed: Apr. 25, 1996

Related U.S. Application Data

[62] Division of Ser. No. 231,932, Apr. 25, 1994, Pat. No. 5,527,448.

[30] Foreign Application Priority Data

Apr. 23, 1993 [FR] France ..... 93 04924

[51] Int. Cl.[6] ..... C01G 65/12

[52] U.S. Cl. ..... 208/15; 208/14; 208/16

[58] Field of Search ..... 208/15, 14

[56] References Cited

U.S. PATENT DOCUMENTS

| | | | |
|---|---|---|---|
| 3,623,973 | 11/1971 | Tarhan et al. | 208/211 |
| 4,240,901 | 12/1980 | Audeh et al. | 208/324 |
| 4,273,645 | 6/1981 | Audeh et al. | 208/323 |
| 4,397,739 | 8/1983 | Jacquin et al. | 208/211 |
| 4,415,436 | 11/1983 | Angevine | 208/15 |
| 4,493,765 | 1/1985 | Long et al. | 208/321 |
| 4,501,653 | 2/1985 | Hamner | 208/15 |
| 4,520,215 | 5/1985 | Owen et al. | 208/15 |
| 4,643,820 | 2/1987 | Zarrineghbal | 208/15 |
| 4,645,585 | 2/1987 | White | 208/15 |
| 4,746,420 | 5/1988 | Darian et al. | 208/222 |
| 4,761,222 | 8/1988 | Carter et al. | 208/321 |
| 4,846,959 | 7/1989 | Kennedy | 208/15 |
| 4,985,139 | 1/1991 | Madgavkar | 208/321 |
| 5,527,448 | 6/1996 | Morel et al. | 208/211 |

FOREIGN PATENT DOCUMENTS

| | | |
|---|---|---|
| 943239 | 12/1963 | European Pat. Off. . |
| 1006949 | 10/1965 | European Pat. Off. . |
| 0 215 496 | 3/1987 | European Pat. Off. . |

*Primary Examiner*—Helane Myers

*Attorney, Agent, or Firm*—Millen, White, Zelano, & Branigan, P.C.

[57] ABSTRACT

A fuel for internal combustion engines having an improved cetane index and lower sulfur content is obtained from a hydrocarbon charge, by a process comprising a step (a) for distillation (D1) in which a bottom product (Q1) is obtained via a line 3 and in which a top product (T1) is obtained via a line 2, a step (b) of liquid/liquid extraction (LE) using a solvent (S1) to obtain a raffinate (R1), (line 5) an extract from which product (Q1) is obtained (line 6), a step c) separating (D2) the raffinate (R1) enabling a product (Q2) to be obtained via line 7, which product has a low solvent (S1) content, and a step (d) of hydrotreatment (HDS) in which the mixture of the products (T1) and (Q2) are subjected to hydrotreatment with a hydrogen partial pressure of less than 10 megapascals, to obtain a product (P) (line 9) which has improved qualities and which contains less than 500 ppm by weight sulphur. According to one particular embodiment, the extract (E1) (line 6) is distilled in order to obtain, via line 11, a bottom product (Q3) which is then conveyed to a hydrotreatment zone in such a way that a product (P') is obtained via a line 12 which contains less than 0.3% by weight sulphur.

7 Claims, 1 Drawing Sheet

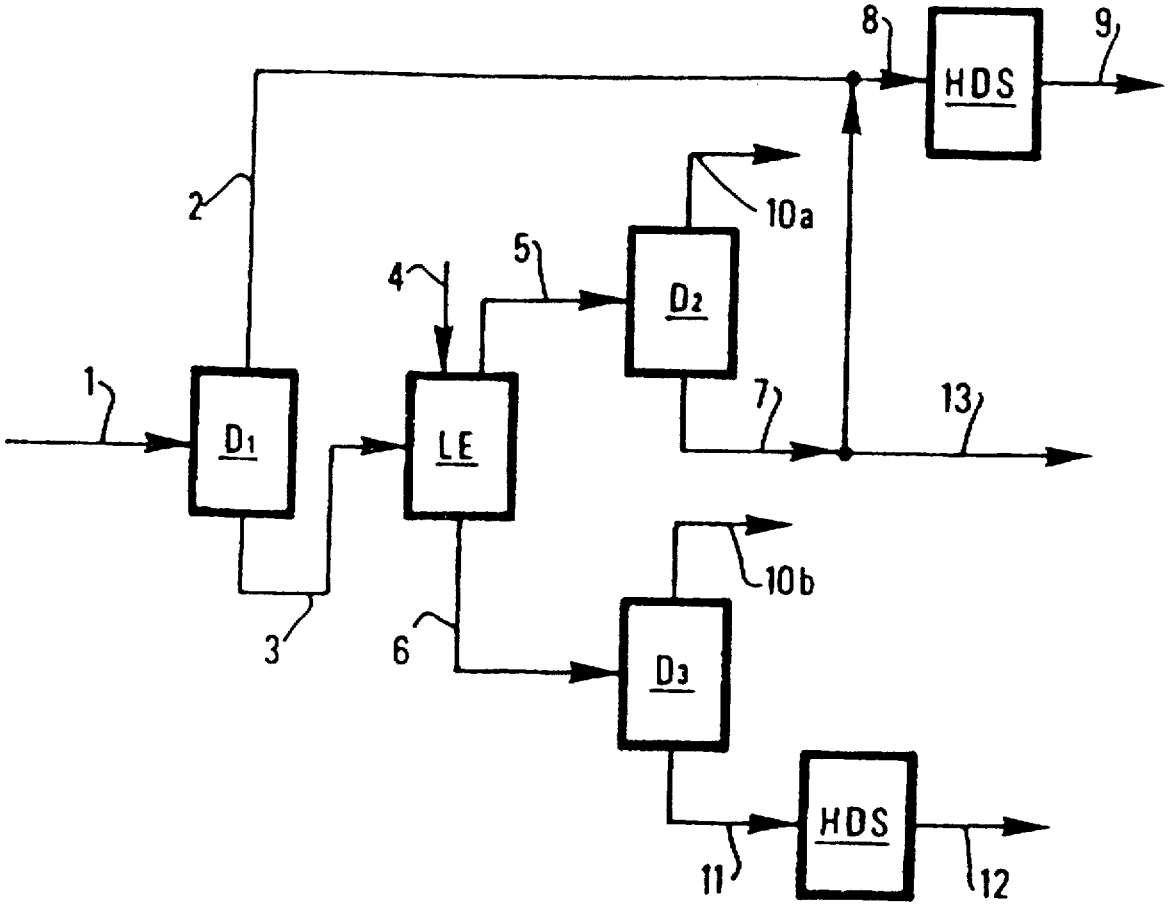
8
9
HDS
2
10a
5
4
D2
1
D1
LE
7
13
10b
3
6
D3
HDS
11
12

PETROLEUM FUEL BASE

This is a division of the application Ser. No. 08/231,932 filed Apr. 25, 1994 now U.S. Pat. No. 5,527,448.

BACKGROUND OF THE INVENTION

The invention is concerned with a petroleum product and a process fop obtaining said petroleum product which may be used fop the formulation of a fuel for an internal combustion engine, and the invention is also concerned with the product obtained by way of the process. The gas oils currently on the market which are either in the form of motor fuels for internal combustion engines with compression ignition (diesel type) or in the form of fuels are most frequently products which have been refined and which contain about 0.3% sulphur (expressed by weight of sulphur). They are usually obtained following a hydrodesulphuration treatment from a charge which can come from direct distillation of a crude petroleum or from a specific treatment of a crude petroleum (pyrolysis or distillation followed by pyrolysis of the fraction recovered during distillation, fop example, or thermal cracking or catalytic cracking) usually containing at least 0.8% by weight of sulphur.

In some industrial countries, standards for the content of sulphur have been set, or are due to be set in the very near future. These standards are becoming increasingly strict, particularly in the case of gas oils which are intended to be used as motor fuels. Thus, in France, particularly from 1995, the sulphur content of these gas oils will have to be at the most equal to 0.05% by weight (500 ppm) whilst the gas oils according to the standards in force have a sulphur content which can be as much as 0.3%.

Similarly, the gas oils used in France as fuels for internal combustion engines must currently have a cetane index which is at least equal to 48, and gas oils used as fuels must have a cetane index which is at least equal to 40. Stricter standards are to be expected in the near future, particularly those concerning gas oils which are used as engine fuels.

Moreover, given the diversity of charges to be treated (crudes of various origin, and viscoreduction-, coking-, hydroconversion-, distillation- or catalytic cracking crudes) to produce the gas oil it is desirable to be able to offer the refiner a process which is flexible and which is capable of adapting the products formed to demand and to satisfy future requirements as far as sulphur and nitrogen levels, cetane index, color and content of aromatics are concerned.

Finally, all existing processes such as hydrodesaromatisation or hydrocracking which enable petroleum products to be obtained which have a low sulphur content and which have a relatively high cetane index expend considerable amounts of hydrogen. By way of example, the process for hydrodesaromatisation of a direct distillation charge whose distillation intervals (ASTM D86) are 180° C.<T 5%<300° C., 260° C.<T 50%<350, 350° C.<T 95%<460° C., expends 0.6 to 1.1% of hydrogen in relation to the charge, whilst the hydrocracking process requires more than 2% hydrogen in relation to its charge. Now, the hydrogen charge of the refinery which usually comes from the catalytic gas reforming unit tends to be inadequate in the light of the fact that gas oil standards are becoming increasingly strict, resulting in an increase in hydrotreatments.

Moreover, these existing processes result in a petroleum product being obtained whose cetane index does not exceed 63, this latter only being attained at the cost of hydrogenation of the aromatic hydrocarbons of the charge, which reaction uses up hydrogen. (see table).

It is therefore desirable to offer the refiner a process which will enable him to produce a petroleum product which satisfies the various standards which will be applicable in the very near future, and after 1995, as far as sulphur content is concerned.

The technological plan is illustrated by the following patents: U.S. Pat. No. 4,985,139, EP-A-0 215 496, GB-A-1 006 949 and GB-A-943 239.

SUMMARY OF THE INVENTION

The present invention is therefore concerned with a product produced by process which is easy to implement, which expends little hydrogen and which can use installations which already exist in the refinery, particularly existing industrial hydrodesulphuration units, which will limit the investments costs needed for implementation of the process. It will permit improvements to the quality of the gas oil produced and will make it possible to satisfy future requirements, particularly those relating to sulphur content. As will be shown in the embodiment described hereinafter, the invention will also permit an improvement to the engine cetane index of the gas oil, to reduce its content of aromatic compounds which do not contain sulphur heteroatom in their molecule, to reduce its content of nitrogenous compounds, to improve its color and smell, and finally to reduce the formation of solid particles when used in an internal combustion engine.

More particularly, the invention is concerned with a petroleum product which can be used as a base in the composition of a fuel for an internal combustion engine with compression ignition, having an improved cetane index and an improved sulphur content, from a hydrocarbon charge which has an initial boiling point of at least 150° C. and a final boiling point of a maximum of 500° C., containing about 0.05% to about 5% by weight of sulphur, about 10% to about 60% by weight of n- and iso-alkanes, about 10% to about 90% by weight of aromatic hydrocarbons at least partly in the form of polyaromatic compounds (with or without sulphur), having a cetane index of about 20 to about 60 and having a nitrogen content of about 50 to about 5 000 ppm (part per million) by weight, said process being characterised in that it comprises the following steps:

a step (a) for distillation, preferably at atmospheric pressure, in which at the bottom a product (Q1) is separated which contains the majority of the polyaromatic compounds and at the top product (T1), a step (b) for liquid/liquid extraction in which the bottom product (Q1) obtained in step a) is contacted at a maximum temperature of 140° C., preferably from 0° to 80° C., under conditions for the extraction of polyaromatic compounds, with a solvent or a mixture of solvents (S1) which enables at least part of the polyaromatic compounds which it contains to be extracted, said solvent having an initial boiling point which is at least 20° C. less, and preferably at least 50° C. less, than the initial boiling point of the bottom product (Q1) obtained in step (a), and during which an extract (E1) is recovered with a high content of polyaromatic compounds and a raffinate (R1), a separation step c), a distillation step, for example, and preferably at atmospheric pressure, for the raffinate (R1) obtained in step (b) in which a product is separated which has a high content of solvent (S1) of a product (Q2) with a low content of solvent (S1).

A hydrotreatment step (d) in which at least part of the top product (T1) obtained in step a) and at least part of the product (Q2) obtained in step c) are introduced into a hydrotreatment reactor, and the mixture obtained is then subjected to hydrodesulphuration under partial hydrogen pressure usually less than about 10 megapascals (MPa) and advantageously less than 5 MPa and preferably about 1.5 to about 3.5 MPa, and a product (P) is recovered which has improved qualities and containing less than 500 ppm by weight of sulphur, for example 100 to 480 ppm.

For the sake of simplicity, the term, "hydrodesulphuration" (HDS) will be used in the rest of this description instead of the word, "hydrotreatment".

The term, "polyaromatic compounds" is used to refer to compounds which have at least two aromatic cycles which may or may not be sulphured.

The temperatures of the initial boiling point and of the final boiling point are TBP cutpoints.

Most frequently, in this embodiment, at least 50% by volume of product (Q2) is introduced, and preferably at least 90%, that is to say all the product, into the hydrodesulphuration reactor. Preferably, all the top product (T1) coming from the distillation operation is introduced into said reactor. This embodiment allows an amount of petroleum product to be obtained which has a very low sulphur content. In other words, a larger quantity of a valorisable product is obtained which will enter into the composition of a fuel for internal combustion engines.

The hydrocarbon charge which is treated according to the process of the invention is most frequently called a gas oil cut, and it preferably has an initial boiling point of about 150° C. and a final boiling point of about 400° C., its sulphur content is usually greater than 0.1% and most frequently greater than 0.5% by weight, its content of aromatic compounds at least partly in the form of polyaromatic compounds is usually about 15% to about 70% by weight, and its content of n- and is-alkanes is between 30 and 45% by weight. This charge is most often a direct distillation gas oil or a pyrolysis gas oil. The color of this charge which is measured using the ASTM D 1500 method is usually greater than or equal to 2. The cetane index according to the standard ISO 5165 of this charge is most often less than about 60, for example about 50 to about 55. The nitrogen content of this charge is usually about 20 to about 3000 ppm, expressed by weight of nitrogen in relation to the weight of the charge.

The product (P) obtained by way of the process of the present invention usually has a nitrogen content expressed by weight of nitrogen which is usually twice less than that of the initial charge and often 4 to 5 times less. This product (P) most often has a color measured according to the Saybolt standard of about 10 to 30, most often of 15 to 25, and the cetane index of the product is usually greater by at least 2 points and often by at least 5 points than the cetane index of the initial charge (2 to 10 points, for example). The content of aromatic compounds not containing a sulphur atom in their molecule in this product (P) is usually reduced by at least 10% by weight compared with that of the initial charge, and often by at least 30% by weight. The sulphur content in relation to that of the initial charge is less than or equal to 5% by weight. The content of n- and of iso-alkanes usually increases by 4 to 15 points, and most often by 6 to 11 points in relation to that of the initial charge.

The invention is advantageously concerned with a petroleum product which can be used, in particular, as a base entering into the composition of a fuel, characterised in that the distillation cut corresponds to 95% by weight of distilled products between 320° C. and 460° C., its cetane index being greater than 60, its content of n- and iso-alkanes being at least equal to 48% by weight, and its sulphur content being less than or equal to 500 ppm (by weight).

Moreover, it has a solvent content which is usually less than 10 ppm by weight, advantageously less than 5 ppm and most often less than 1 ppm.

The distillation is carried out under conditions which enable a product (T1) at the top to be obtained which only contains a small proportion of compounds with at least one sulphur atom in their molecule which are very difficult to hydrotreat. When the distillation operation is carried out at atmospheric pressure, the overhead product is usually a fraction whose final boiling point is less than 360° C., preferably less than 330° C., for example about 310° C. The bottom product (Q1) is usually a fraction whose initial boiling point is greater than about 300° C., often greater than 330° C. and sometimes greater than 360° C., which enables the refractory sulphured compounds of the raffinate to be eliminated which would necessitate subsequent hydrotreatment at a higher pressure and therefore at much higher cost.

Moreover, by carrying out the distillation operation under these preferred conditions, an amount of residue is conveyed to the extraction unit which represents a maximum of 30% of the initial charge, for example, which makes it possible to use the existing extraction units which are usually smaller in size and of optimising the output of these units.

The liquid/liquid extraction step is a step which is carried out under conventional conditions. The extraction operation can be carried out, for example, at counter-current in a conventional device such as a filled column, a column with plates or a column with mechanical agitation (R.D.C.: rotating disc contactor) which usually has 1 to 20 theoretical stages and preferably 5 to 10 stages at a temperature which is usually between 0° and 140° C., advantageously between 30° C. and 80° C. and at a pressure which makes it possible for the operation to be carried out in liquid phase and thus between 0.1 and 1 MPa, preferably between 0.1 and 0.3 MPa. The ratio in volume of solvent (S1) to the volume of bottom product (Q1) is usually 0.2:1 to 5:1, preferably about 0.5:1: to about 2:1, and most frequently about 1:1. The solvent is preferably selected from the group of solvents which makes it possible for at least a part of the aromatic compounds to be extracted which do not contain a sulphur atom in their molecule and which are present in the product (Q1) obtained in step a). The extraction conditions are preferably selected in such a way that a raffinate (R1) is obtained which contains a maximum of 90% by weight, and preferably a maximum of 70% by weight, of the total weight of the aromatic compounds which do not contain a sulphur atom in their molecule and which are present in the product (Q1) obtained in step (a). Under these conditions, the extract (E1) will contain at least 10%, and often at least 30%, by weight of the total weight of the aromatic compounds which do not contain a sulphur atom in their molecule and which are present in the product (Q1) obtained in step (a).

The extraction solvent is most frequently one single solvent, but it is also possible to use mixtures of solvent. This solvent usually contains less than 20% and often less than 10% by weight of water. The solvent can be an anhydrous solvent. It is most frequently selected from the group formed by methanol, acetonitrile, monomethylformamide, dimethylformamide, dimethylacetamide, furfural, N-methyl pyrolidone and dimethyl sulphoxide. Dimethylformamide, N-methylpyrolidone or furfural are often used.

It is also possible to add to the extraction solvent at least one co-solvent which can be an alcohol with 1 to 6 carbon atoms, such as a linear or branched alcohol, for example, or furfuryl alcohol.

If the charge to be treated has a high final boiling point, and has a particularly high content of nitrogenous compounds, particularly basic compounds, it can be advantageous to introduce with the extraction solvent which may be on its own or in a mixture, a lesser quantity of acids, particularly carboxylic acids (less than 1% by weight in relation to the solvent, fop example). Of these, it is advantageously possible to cite carboxylic acids with 1 to 6 carbon atoms, more particularly acids with a boiling temperature of less than 250° C., in particular formic acid, acetic acid, propionic acid, butanoic acid, pentanoic acid, maleic acid, crotonic acid, isobutyric acid, valeric acid, trimethylacetic acid, benzoic acid, and 2-furoic acid.

The raffinate (R1) obtained in step b) is then conveyed to a distillation zone, for example, in which it is distilled under conditions enabling an overhead fraction to be recovered which has a high content, preferably a very high content, of solvent (S1) and a product (Q2) which preferably has a greatly reduced content of solvent (S1). Most often, the conditions of this distillation operation are selected in such a way that a leading fraction is obtained which contains almost all the solvent, that is to say more than 95% by weight, for example, of the amount of solvent contained in the raffinate (R1) and introduced into the distillation zone. Therefore, preferably at least about 99% by weight of the amount of solvent contained in the raffinate (R1) is recovered.

According to another mode of operation, the raffinate can be conveyed to at least one separation recipient where a liquid-vapour equilibrium (flash) is carried out, and a product (S1) is obtained which has a high content of solvent, and a product (Q2) is obtained which has a low content of solvent. The recipient(s) can be followed by a stripping operation with steam or nitrogen, for example, to recover the last traces of solvent.

The parameters of the hydrodesulphuration step which are usually selected are most frequently the same as the parameters of a hydrodesulphuration step carried out under gentle conditions. In other words, the spatial speed can be fast, for example faster than $2H^{-1}$.

The catalyst is one of those marketed by the PROCATALYSE company, for example.

Likewise, in one particular embodiment, the extract (E1) obtained in step (b) is then conveyed to a separation zone, such as a distillation zone in which it is distilled under conditions which enable a fraction to be recovered which has a high content, and preferably a very high content, of solvent (S1) and a product (Q3) which has a reduced content of solvent (S1). Most frequently, the conditions of this separation are selected in such a way that a product is obtained which contains almost all the solvent, that is to say more than 95% by weight, for example, of the amount of solvent contained in the extract (E1) and introduced into the separation zone. Therefore, preferably at least about 99% by weight of the quantity of solvent contained in the extract (E1) is recovered.

In one advantageous embodiment of the invention, the product (Q3) is conveyed to a hydrodesulphuration zone in which it is subjected to a hydrodesulphuration treatment, for example in the presence of a catalyst marketed by the company PROCATALYSE under conditions which are usually rather strict and which enable a product (P') to be obtained which has a sulphur content which is less than or equal to 0.3% by weight and preferably less than or equal to 0.2% by weight, that is to say less than or equal to 0.1% by weight. That product (P') cannot, of course, be used as an engine fuel since the amount of sulphur which it contains is usually in excess of the future standard, but it could be used as a fuel.

According to another embodiment, at least part of the product (Q2) can be recovered from step c) via lines (7) and (13) and used as it is as a fuel or it can be mixed with the product (P') which results from the hydrodesulphuration of the product (Q3), or it can even be conveyed in a mixture with at least part of the product (Q3) into a hydrodesulphuration zone. Thus, according to this realisation, part of the product obtained is at least partly desulphured and can be used as a major fuel.

In one particularly advantageous embodiment of the invention, the product(s) obtained by separating the raffinate (R1) and possibly the extract (E1) which has/have a high content of solvent are recycled to step b) for liquid/liquid extraction.

The process of the present invention has increased flexibility compared with the processes described in the prior art. Moreover, it has the following main advantages: in the raffinate (table) the content of n- and iso-alkanes is higher than with hydrocracking or hydrodesaromatisation processes, and the cetane index is higher, despite the fact that the content of aromatic hydrocarbons is greater than 10%. Moreover, hydrogen consumption in the hydrotreatment is less. It can be reduced, for example, to 0.15% by weight in relation to the charge, whilst the hydrogenation is restricted to the maximum.

COMPARATIVE TABLE

| | hydrocracking | hydro-desaromatisation | Process according to the invention |
|---|---|---|---|
| density | 0.815–0.825 | 0.820–0.850 | 0.815–0.840 |
| cetane | 53–63 | 45–60 | 62–71 |
| n- and iso-alkanes* | 42–47 | 35–45 | 49–56 |
| Naphthenes* | 49–55 | 25–55 | 30–41 |
| Aromatics* | 3–7 | 10–20 | 10–20 |
| Consumption** of hydrogen % | >2 | 0.6–1.1 | <0.5 |

*analysis using the Fisher method (% by weight)
**in % by weight $H_2$ in relation to the charge

BRIEF DESCRIPTION OF THE DRAWING

The attached FIGURE is a block diagram of a process for producing the petroleum product of the invention.

The following example illustrates the invention without limiting the scope thereof.

EXAMPLE

The charge used in this example is a direct distillation gas oil (straight-run) with a cetane index of 55, a total content of aromatic compounds which may or may not be sulphured of 34% by weight, a content of n- and iso-alkanes of 18% by weight and 22% by weight, a sulphur content of 1.22% by weight, a content of nitrogen expressed by weight of nitrogen of 255 ppm and a color measured according to the ASTM D 1500 standard which is equal to 2. This gas oil has an initial distillation point of 150° C. and final distillation point of 400° C.

This charge is introduced via the conduit 1 into a distillation zone from which a top fraction (T1) with a final boiling point of less than 320° C. is recovered via the conduit 2 and which contains 0.88% by weight of sulphur, and via the conduit 3 a bottom fraction (Q1) is recovered which has a final boiling point greater than 320° and containing 1.7% by weight of sulphur. The top product (T1) is conveyed via the conduit 2 and the conduit 8 into a hydrodesulphuration zone (HDS).

The bottom product (Q1) issuing from the distillation zone D1 is conveyed via the conduit 3 into the extraction zone (LE) into which an amount of dimethylformamide is introduced via the conduit 4 which is equal in volume to the amount of bottom product (Q1) introduced into this zone. This zone is an extraction column which comprises a packing formed from Pall rings which correspond to three theoretical stages. The extraction operation is carried out at counter-current, at atmospheric pressure and at a temperature of 70° C. A raffinate (R1) is obtained which is conveyed via the conduit 5 into the distillation zone D2 at the top of which the dimethylformamide is separated which is recovered via the conduit 10*a* so that it may be recycled to the extraction zone, and at the bottom a raffinate (Q2) is recovered which now has almost no dimethylformamide, having a sulphur content of 0.51% which is conveyed via the conduit 7 and the conduit 8 to the hydrodesulphuration zone (HDS).

The products (T1) and (Q2) which are introduced into the hydrodesulphuration zone are subjected to a hydrodesulphuration treatment at a partial hydrogen pressure of 2.5 MPa in the presence of an industrial catalyst containing cobalt and molybdenum on an alumina support sold by the company PROCATALYSE under the reference HE 306C, the temperature being kept at 330° C., the recycling of hydrogen is equal to 200 litres per litre of charge and the spatial speed per hour is 2.5 $h^{-1}$. By way of comparison, a hydrodesulphuration operation which is as effective which is carried out directly on the same gas oil has to be carried out at a spatial speed per hour of 1.5 $h^{-1}$, but all other conditions remain substantially the same.

A product (P) is recovered via the line 9 which contains 450 ppm of sulphur, 20% by weight of aromatic compounds. This product has a color measured using the Saybolt method which is equal to 20 and a nitrogen content of 50 ppm by weight. The cetane index of the product (P) is 62. This product is incorporated into the Diesel pool. The content of n- and iso-alkanes is 21% by weight and 31% by weight.

An extract (E1) is also recovered via the conduit 6 which is conveyed to a distillation zone D3 at the top of which the dimethylformamide is separated which is recovered via the conduit 10*b* so that it may be recycled to the extraction zone, and at the bottom an extract (Q3) is recovered which now contains almost no dimethylformamide and which has a sulphur content of 5.1% which is conveyed via the conduit 11 to a hydrodesulphuration-zone (HDS) separate therefrom into which the raffinate (Q2) and leading product (T1) are introduced. The hydrodesulphuration operation is carried out in the presence of the catalyst MR 306C at a partial hydrogen pressure of 4 MPa, at a temperature of 350° C. and with recycling of hydrogen of 300 litres per litre of charge and at a spatial speed per hour of 1.2 $h^{-1}$.

A product (P') is recovered via the line 12 which contains 0.2% by weight of sulphur, 75% by weight of aromatic compounds. The product has a color measured using the ASTM D-1500 method which is equal to 1 and a nitrogen content of 200 ppm by weight. It can be conveyed to the domestic fuel pool.

We claim:

1. A petroleum product useful as a base in a fuel composition for an internal combustion engine with compression ignition, having the following properties:

| | |
|---|---|
| Cetane Index: | 62–71 |
| Normal and Iso alkanes | 49–56% by weight |
| Naphthenes | 30–41% by weight |
| Aromatics | 10–20% by weight |
| Sulfur | less than 500 ppm |
| Nitrogen | less than 600 ppm |
| Color | 10–30. |

2. A product according to claim 1, wherein the sulfur content is 100–480 ppm.

3. A product according to claim 1 having a nitrogen content of not more than about 250 ppm.

4. A product according to claim 2 having a color of 15–25.

5. A product according to claim 3 having a color of 15–25.

6. A petroleum product useful in a fuel composition for an internal combustion engine with compression ignition, having the following properties:

| | |
|---|---|
| Cetane Index: | 62 |
| Normal and Iso alkanes | 52% by weight |
| Naphthenes | 30–41% by weight |
| Aromatics | 20% by weight |
| Sulfur | 450 ppm |
| Nitrogen | less than 50 ppm |
| Color | 20. |

7. A product according to claim 1, having a nitrogen content of about 50–125 ppm.

* * * * *